United States Patent [19]

Mikosinski

[11] 4,180,899

[45] Jan. 1, 1980

[54] METHOD OF ASSEMBLING A FASTENER

[76] Inventor: Ronald M. Mikosinski, 5852 Augusta Blvd., Chicago, Ill. 60651

[21] Appl. No.: 823,034

[22] Filed: Aug. 9, 1977

[51] Int. Cl.[2] ..... B21D 39/00; B23P 11/00

[52] U.S. Cl. ..... 29/512; 24/94; 24/95; 24/216; 29/523; 403/274

[58] Field of Search ..... 29/512, 522, 523; 24/94, 95; 403/274

[56] References Cited

U.S. PATENT DOCUMENTS

| | | | |
|---|---|---|---|
| 143,512 | 10/1873 | Johnson et al. | 24/94 |
| 211,882 | 2/1879 | Bates | 24/95 |
| 465,061 | 12/1891 | Jackson | 24/95 |
| 496,357 | 4/1893 | Hall | 24/95 |
| 1,931,728 | 10/1933 | Johnson | 24/94 UX |
| 2,759,237 | 8/1956 | Scovill | 24/216 |
| 3,083,430 | 4/1963 | Shears | 24/216 |
| 3,918,140 | 11/1975 | Konstant | 29/271 |

*Primary Examiner*—Charlie T. Moon

*Attorney, Agent, or Firm*—Lockwood, Dewey, Alex & Cummings

[57] ABSTRACT

A round disk having a central aperture therein, such as the base of a shotgun shell or a facsimile thereof is utilized in the fabrication of a fastener, and a tubular member such as the sleeve of a primer is positioned through the aperture and formed into a fastening member. When an actual shotgun shell is utilized, the base is separated from the remainder of the shell, and the inner end of the shell primer is utilized to retain an external member which sandwiches a sheet of material such as fabric, leather or the like, therebetween. The shotgun shell type fastener may be utilized as a button, snap, decorative attachment or the like.

2 Claims, 4 Drawing Figures

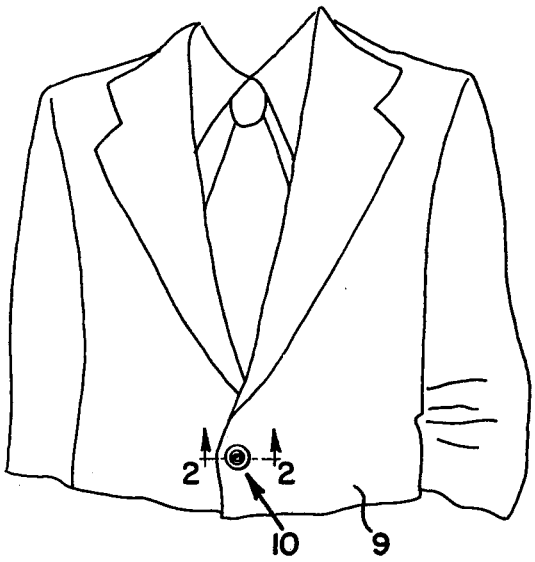
FIG. 1
FIG. 2
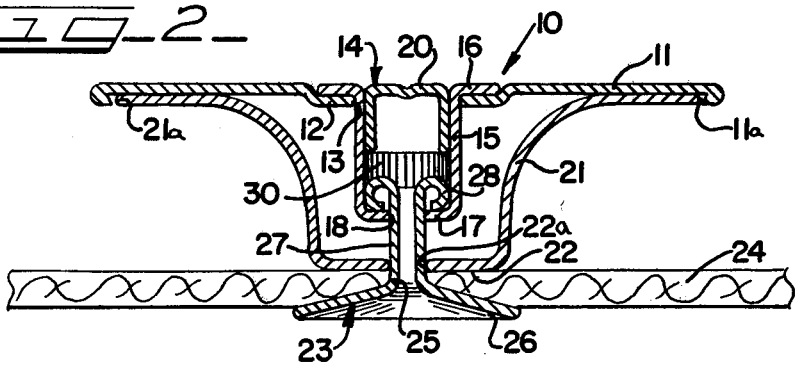
FIG. 3
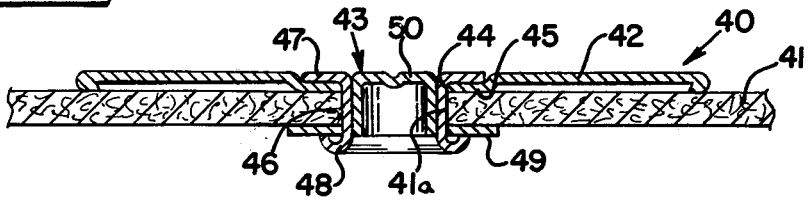
FIG. 4
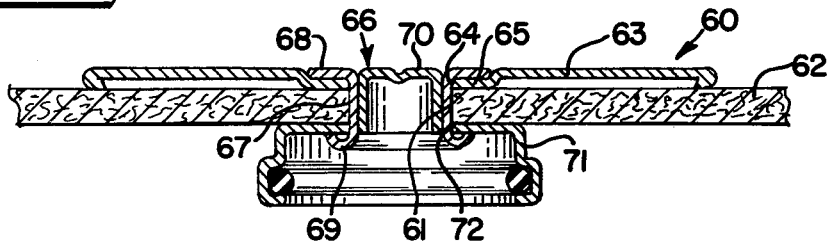

METHOD OF ASSEMBLING A FASTENER

BACKGROUND OF THE INVENTION

The invention relates to fasteners made utilizing a round disk having a central aperture therein. Examples of such disks include the bases of shotgun shell cartridges of varying sizes. More particularly, the invention relates to a method of making a button, snap, or decorative attachment which may be permanently affixed to fabric, vinyls, leather or the like by using the disk together with a tubular sleeve member positioned through the disk aperture as a fastening member. An example of such a tubular member is a primer casing of a shotgun shell.

Heretofore, buttons have been made from the bottoms of shotgun shells. Such buttons generally have been made by cutting the base of the metal shell from the hollow cylindrical side surface thereof. Formation of the base included cutting across the interior portion of the primer casing which is positioned through a central aperture in the shell base. After the base of the shell is removed from the remainder thereof, a metal eyelet has been soldered to the hollow inside of the primer to form a button. The button may then be attached to any garment, or the like, by conventional sewing means utilizing thread. Typically, buttons made from shotgun shell bases are utilized with rustic outdoors-type clothing and accessories.

Other buttons have utilized plastic disks having a central aperture therein. The buttons are fastened with a plastic rivet which is inserted through the disk and fabric by a spring loaded gun type mechanism.

The growth of the clothing and accessory industries, and particularly as those industries relate to rustic-accentuated clothing, camping gear, and the like, has given rise to increased demand for the use of decorative and utilitarian fasteners made of shotgun shells or facsimiles thereof.

It is therefore an object of the present invention to provide an improved fastener for apparel utilizing the bottom face of a shotgun shell or a facsimile thereof.

It is a further object of the present invention to provide a fastener utilizing a round disk having a central aperture therein and a tubular member secured in the disk aperture wherein both are permanently affixed to a sheet of material by metal rivet means.

Another object of the invention is the provision of a decorative and utilitarian snap fastening for apparel material and apparel accessory material utilizing the base of a shotgun shell wherein the shotgun shell primer is utilized as a fastening means.

SUMMARY OF THE INVENTION

The invention is directed to a fastener means for using with apparel and apparel accessories. The fastener means includes a substantially circular disk having a fixed annular exterior surface which defines an aperture positioned centrally therethrough. A substantially tubular member is positioned through the disk aperture and includes a radially extending flange adjacent one end thereof which maintains the tubular member in the disk central aperture. A fastening member has a substantially annular portion thereof which is adapted to coact with the tubular member to bias the fastener against any sheet of material which is positioned between the disk and the fastening member.

The invention is further directed to a method of assembling a fastener from a generally cylindrical disk, such as the base of a shotgun shell which includes a central aperture therethrough and a tubular member such as a primer casing. The cylindrical disk and tubular member are attached to a sheet of material such as fabric, leather and the like through an aperture in the material. The method includes the steps of: positioning the tubular member through the disk aperture until the flange on the tubular member engages an external face of the disk; inserting one of the tubular member or the fastening member through the aperture in the sheet of material until one of the base surface of the disk or a radially extending surface on the fastener, respectively, engages the sheet of material; engaging the fastening member with the distal end of the tubular member; and curling one of the tubular member and an annular edge on the fastening member to fixedly engage the other of the members against an opposing surface on the sheet of material.

BRIEF DESCRIPTION OF THE DRAWINGS

The features of the present invention, which are believed to be novel, are set forth with particularity in the appended claims. The invention, together with further objects and advantages thereof, may best be understood by reference to the following description of preferred embodiments taken in connection with the accompanying drawings, wherein:

FIG. 1 is a partial perspective view of a person wearing a suitcoat incorporating the shotgun shell type button of the invention.

FIG. 2 is a cross-sectional view taken along line 2—2 of FIG. 1.

FIG. 3 is a cross-sectional view similar to that shown in FIG. 2 wherein the shotgun shell base or a facsimile thereof is affixed to a sheet of material as a decorative attachment.

FIG. 4 is a cross-sectional view similar to that shown in FIG. 2 wherein the shotgun shell type base is utilized as a mounting for a snap socket.

DETAILED DESCRIPTION OF THE PREFERRED EMBODIMENTS

Referring to FIGS. 1 and 2, the fastener of the invention is generally indicated at 10. In FIG. 1 the fastener is shown as a button mounted on a sport coat 9. Button 10 includes a shotgun shell base or annular disk 11 having a recessed annular central flange 12 with a central aperture 13 therein. A conventional primer or tubular member, generally indicated by the numeral 14, is mounted in aperture 13. Primer 14 includes a hollow cylindrical casing having an outer annular flange 16 which overlaps recessed flange 12 at one end of the casing, and an inner annular flange 17 having a central aperture 18 therein. When the cartridge base 11 is originally separated from the remainder of the spent shotgun shell, aperture 18 is smaller in diameter than shown in FIG. 2. The aperture is enlarged or opened up slightly in the first embodiment, and enlarged to a much greater extent in other embodiments to be discussed below. The primer 14 further includes a hollow cap 20 pressed into the outwardly flanged outer end 16 of the primer to enclose the same.

While one preferred embodiment of the invention utilizes an actual shotgun shell, it should be noted that a facsimile of a shotgun shell base may also be utilized within the scope of the invention. If such a facsimile is utilized, a tubular insert, similar to the actual primer casing 15 may be inserted in the central disk aperture 13. A preferred material for the disk 11 is brass. Commonly, the tubular member 15 is formed of brass, copper or steel, and a preferred material for the cap 20 is brass. If a real shell casing is not utilized, an unlimited number of variations in pattern may be stamped into the disk top surface.

A bell washer 21 having a curved cross-section includes a circular outer rim 21*a*, a substantially flat circular base 22, and circular aperture 22*a* centrally positioned on the base is mounted on the back surface of the disk. A rivet, generally indicated at 23, coacts with the primer to fasten the button 10 to the sheet of material 24, which is made of fabric, leather, or the like. Sheet 24 includes an aperture 25 through which the rivet is positioned. Rivet 23 includes a radially outwardly extending flange 26 which extends from a central tubular portion 27. The tubular portion 27 extends through the fabric aperture 25, the bell washer aperture 22*a*, and the primer casing aperture 18. The distal end of tubular member 27 is curled outwardly at 28 to retain the button 10 on the fabric 24. A curling die 30 is positioned in the primer 14 between the end 28 of rivet 23 and the primer cap 20 to cause the rivet end to curl when pressed therein and to prevent movement of the members within the primer after it is assembled.

In order to assemble the button 10 and fasten it to the fabric 24, the base 11 of the shotgun shell is removed from the remainder of the shotgun shell, preferably by cutting along the annular rim 11*a* thereof so that a portion of outer rim 11*a* extends inwardly of the outermost circumference of the base. Next, the primer is disassembled and an interior member therein (not shown) is removed. Then, the aperture 18 on the inner flange 17 of primer casing 15 is enlarged, preferably by a punching process, to allow the tubular portion 27 of rivet 23 to be inserted therein. The primer is re-assembled with a curling die 30 inserted therein and positioned as shown in FIG. 2.

Thereafter, the bell washer 21 is positioned on the back side of shell base or disk 11 such that the primer casing aperture 18 and the central aperture 23 of the bell washer are in aligned spatial relation. It is preferred that an adhesive be positioned between the back side of disk 11 and bell washer 21 to maintain the two members together until the assembly of the fastener is complete. Alternatively, the inwardly extending portion of the rim 11*a* on the base 11 is crimped over the outer edge 21*a* of bell washer 21 to retain the bell washer on the shell base.

Next, the button 10 is preferably positioned face down on a flat secure surface (not shown), the sheet fabric 24 is positioned over the button such that the aperture 25 therein is aligned with the bell washer central aperture 22*a*. The tubular portion 27 of rivet 23 is then inserted through the three respective aligned apertures until the rivet distal end impinges against the curling die 30. The button is biased together and fastened to the fabric when pressure is applied to the rivet 23 sufficient to curl the distal end thereof inside the casing 15.

Referring to FIG. 3, a decorative attachment, generally indicated at 40, may be affixed to one sheet of material 41 for decorative purposes, or may be utilized to fasten two or more sheets of material together. Decorative attachment 40 includes, as in FIG. 2 above, a base 42 of a shotgun shell or a facsimile thereof. Shotgun shell base 42 has a primer or tubular member, generally indicated at 43 positioned through an aperture 44 which is centered on an annular recessed flange 34 on the base 42. Primer 43 includes a hollow cylindrical casing 46 having a radially extending outer annular flange 47 which matingly engages the base annular recess 45 to mount the primer thereon, and an annular curled inner end 48 positioned on the opposing side of material 41 from the shell base. The curled primer end coacts with a washer 49 to hold the decorative attachment 40 to the sheet of material 41 through a central aperture 41*a* in the sheet. A primer cap 50 is pressed into the radially extending flange end of the primer to provide a cover for same.

In order to assemble the decorative attachment 40 on the sheet of material 41, the base 42 of the shotgun shell is removed from the remainder of the shell in a manner similar as in the embodiment shown in FIG. 2, or a facsimile is stamped from sheet stock. Next, the inner end of the hollow primer casing is fully opened, i.e., the annular end 48 is made to extend axially of the casing 46 rather than radially thereof. It should be noted that if a tubular member is utilized rather than an actual primer casing, the last mentioned step may be eliminated. The primer casing 46 is then inserted through an aperture 41*a* in the sheet of material 41 to which the attachment is to be affixed. A flat washer 49 of conventional configuration is inserted over the primer casing on the opposite side of the sheet 41 from which the shotgun shell base 42 is positioned. Next, the face of disk 42 is positioned against a flat surface and a curling die (not shown) is then pressed against the member 46 to curl the annular end 48 thereof outwardly until the decorative attachment 40 firmly retains the sheet of material 41 and the washer 49. It should be noted that a plurality of sheets of material 41 may be fastened together utilizing the decorative attachment 40.

Referring to FIG. 4, the female portion of a snap fastener incorporating the shotgun shell type base is generally indicated at 60, and is fastened through an aperture 61 in a sheet of material 62. Snap fastener 60 includes a shotgun shell base 63 or a facsimile thereof having a central aperture 64 positioned in an annular recess 65 therein. A primer or tubular member, generally indicated at 66, is mounted through the base aperture 64 and includes a hollow cylindrical body 67 having a radially extending top flange 68 and an outwardly curled bottom flange 69. Primer 66 also includes a top cap 70 which is pressed into the hollow interior of the casing 67 to cover same. In this embodiment, the socket portion of a snap fastener 71 is retained on the opposing side of material 62 from the cartridge base 63 by the bottom primer casing flange 69 which extends outwardly over a central aperture 72 in the socket 71 to retain same on the fastener 60.

In order to assemble the socket portion of snap fastener 60, the shotgun shell base 63 is removed from the remainder of the shotgun shell in the manner described in the previous embodiments, or a round stamped disk is utilized. Likewise, the interior end of primer casing 67 is opened similarly as described in the embodiment shown in FIG. 3, or a tubular member is substituted therefor. If a real shell cartridge is utilized, the primer cap 70 is removed before the primer casing distal end is enlarged and it is then re-positioned in its original position. It should be noted that the cap 70 may also be a facsimile. Next, a central aperture 72 in the snap fastener socket 71 is enlarged until it fits over the outside of primer casing 67. The inner end of the primer 66 is inserted through aperture 61 on the sheet of material 62. The snap socket 71 is then inserted on the shell primer through the aperture 72 centrally therein so that the flat side of the socket is positioned against the sheet of material. Next, a curling die is utilized to curl the inner end 69 outwardly to retain the socket 71, the sheet of material 62, and the shell base 60 together in one structure.

While three particular embodiments of the present invention have been shown and described, it will be obvious to those skilled in the art that changes and modifications may be made without departing from the invention in its broader aspects. For example, a male snap fastener member may be mounted on a sheet of material utilizing the method of mounting the socket member as shown in FIG. 4. Therefore, the aim in the appended claims is to cover all such changes and modifications as fall within the true spirit and scope of the invention.

I claim:

1. In a method of assembling a decorative attachment from a generally cylindrical disk, such as the base of a shotgun shell which includes a central aperture therethrough and a tubular member such as a primer casing, and attaching same to a sheet of material such as fabric, leather and the like through an aperture therein; said method comprising the steps of:

positioning said tubular member through said disk aperture until a radially outwardly extending flange positioned at one end of said tubular member engages an external face of said disk;

inserting said tubular member through said aperture in said sheet of material until of a back surface of said disk engages a surface of said sheet of material;

positioning a washer over the distal end of said tubular member with said member extending through a central aperture on said washer; and curling the distal end of said tubular member outwardly to fixedly retain said washer against an opposing surface of said sheet of material.

2. In a method of assembling a snap from a generally cylindrical disk, such as the base of a shotgun shell which includes a central aperture therethrough and a tubular member such as a primer casing, and attaching same to a sheet of material such as fabric, leather and the like through an aperture therein; said method comprising the steps of:

positioning said tubular member through said disk aperture until a radially outwardly extending flange positioned at one end of said tubular member engages an external face of said disk;

inserting said tubular member through said aperture in said sheet of material until a back surface of said disk engages a surface of said sheet of material;

positioning a snap socket member over the distal end of said tubular member with said member extending through a central aperture on said socket member; and curling the distal end of said tubular member radially outwardly to fixedly retain said snap socket against an opposing surface of said sheet of material.

* * * * *